US012508466B2

(12) United States Patent
Larson et al.

(10) Patent No.: US 12,508,466 B2
(45) Date of Patent: Dec. 30, 2025

(54) WEIGHTLIFTING SYSTEM

(71) Applicant: Rep Fitness LLC, Westminster, CO (US)

(72) Inventors: Joseph G. Larson, Westminster, CO (US); Samuel M. Pizer, Denver, CO (US); Ryan James McGrotty, Erie, CO (US)

(73) Assignee: Rep Fitness LLC, Westminster, CO (US)

( * ) Notice: Subject to any disclaimer, the term of this patent is extended or adjusted under 35 U.S.C. 154(b) by 93 days.

(21) Appl. No.: 18/623,936

(22) Filed: Apr. 1, 2024

(65) Prior Publication Data

US 2024/0325815 A1 Oct. 3, 2024

Related U.S. Application Data

(60) Provisional application No. 63/455,731, filed on Mar. 30, 2023.

(51) Int. Cl.
*A63B 21/00* (2006.01)
*A63B 21/062* (2006.01)

(52) U.S. Cl.
CPC ..... *A63B 21/151* (2013.01); *A63B 21/063* (2015.10)

(58) Field of Classification Search
CPC . A63B 21/151; A63B 21/063; A63B 21/0628; A63B 21/156; A63B 21/4043; A63B 21/4035; A63B 21/154
See application file for complete search history.

(56) References Cited

U.S. PATENT DOCUMENTS

| | | | | |
|---|---|---|---|---|
| 5,518,477 | A | 5/1996 | Simonson | |
| 10,744,365 | B2 * | 8/2020 | Kuo | A63B 21/4033 |
| 10,814,172 | B1 | 10/2020 | Ilfrey et al. | |
| 11,065,496 | B2 * | 7/2021 | Leipheimer | A63B 21/0783 |
| 12,048,858 | B1 * | 7/2024 | Schroeder | A63B 21/00047 |
| 12,239,871 | B1 * | 3/2025 | Ilfrey | A63B 21/153 |

(Continued)

OTHER PUBLICATIONS

International PCT Patent Application No. PCT/US2024/022542, filed Apr. 1, 2024. International Search Report dated Jul. 25, 2024. 2 pages.

(Continued)

*Primary Examiner* — Andrew S Lo
(74) *Attorney, Agent, or Firm* — NOD Law PC

(57) ABSTRACT

A weightlifting system includes a frame with lower, middle, and upper pulley stations mounted therein. A load attachment structure is provided within the system. A cable-pulley system includes a plurality of fixed pulleys mounted to the frame, first and second moveable pulleys, and a floating load pulley mounted to the load attachment structure. A plurality of cables is collectively routed through the first and second movable pulleys, the plurality of fixed pulleys, the floating load pulley, and the lower, middle, and upper pulley stations. When a first pulling force is applied to a first cable end accessible from the lower pulley station, the first movable pulley and the load pulley translate. When a second pulling force is applied to a second cable end accessible from the upper pulley station, the second movable pulley and the load pulley translate. When a third pulling force is applied to a third cable end accessible from the middle pulley station, only the load pulley translates.

20 Claims, 6 Drawing Sheets

(56) References Cited

U.S. PATENT DOCUMENTS

| | | | | |
|---|---|---|---|---|
| 2017/0319941 | A1 | 11/2017 | Smith et al. | |
| 2019/0336812 | A1* | 11/2019 | Leipheimer ..... | A63B 23/03525 |
| 2020/0155889 | A1* | 5/2020 | Leipheimer ..... | A63B 21/00065 |
| 2021/0220704 | A1* | 7/2021 | Claudio ..... | A63B 21/0058 |

OTHER PUBLICATIONS

International PCT Patent Application No. PCT/US2024/022542, filed Apr. 1, 2024. Written Opinion of the International Searching Authority dated Jul. 25, 2024. 4 pages.

* cited by examiner

WEIGHTLIFTING SYSTEM

CROSS REFERENCE TO RELATED APPLICATIONS

This application claims the benefit of priority pursuant to 35 U.S.C. § 119 (e) of U.S. provisional application No. 63/455,731 filed 30 Mar. 2023 entitled "Weightlifting system," which is hereby incorporated herein by reference in its entirety.

TECHNICAL FIELD

The technology described herein relates to cable-pulley weightlifting systems.

BACKGROUND

A variety of exercise machines exist to train specific muscles or muscle groups. For example, leg curl machines may be used to exercise the hamstrings, while leg extension machines may be used to exercise the quadriceps. For the upper body, pull-down machines are used to exercise the latissimus dorsi, while so-called "pec decks" may be used to exercise the pectorals. Other specific machines for weight training of specific body parts are known. While systems existing to exercise multiple body parts or muscle groups, such systems often take up a large physical footprint, often with a specialized machine for performing single exercise directed to a muscle group, which may be undesirable for small home gyms where space is at a premium.

The information included in this Background section of the specification, including any references cited herein and any description or discussion thereof, is included for technical reference purposes only and is not to be regarded subject matter by which the scope of the invention as defined in the claims is to be bound.

SUMMARY

The technology disclosed herein relates to a weightlifting system, which is built around a frame including a front post, a rear post spaced apart from and parallel to the front post, a lower crossmember connected between the front and rear posts at a base position, and an upper crossmember connected between the front and rear posts at an upper position. A load attachment structure is provided within the system. A lower pulley station is mounted on the frame and disposed proximate to the lower crossmember. An upper pulley station is mounted to the frame and disposed proximate to the upper crossmember. A middle pulley station is attached to the frame. A cable-pulley system includes a plurality of fixed pulleys mounted to the frame, a first moveable pulley, a second moveable pulley, and a floating load pulley mounted to the load attachment structure. A plurality of cables is collectively routed through the first movable pulley, the second movable pulley, the plurality of fixed pulleys, the floating load pulley, the lower pulley station, the upper pulley station, and the middle pulley station. When a first pulling force is applied to a first cable end of the plurality of cables routed through and accessible from the lower pulley station, the first movable pulley and the load pulley translate. When a second pulling force is applied to a second cable end of the plurality of cables routed through and accessible from the upper pulley station, the second movable pulley and the load pulley translate. When a third pulling force is applied to a third cable end of the plurality of cables routed through and accessible from the middle pulley station, only the floating load pulley translates.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. A more extensive presentation of features, details, utilities, and advantages of the present invention as defined in the claims is provided in the following written description of various embodiments and implementations and illustrated in the accompanying drawings.

BRIEF DESCRIPTION OF THE DRAWINGS

The disclosure will be readily understood by the following detailed description in conjunction with the accompanying drawings, wherein like reference numerals designate like structural elements.

The use of cross-hatching in the accompanying figures is generally provided to indicate a surface of a cross-section cut. The use of contour lines, shading, or stippling in the accompanying figures is generally provided indicate surface features, including curved surfaces or changes in depth, to clarify boundaries between adjacent elements, and to facilitate legibility of the figures. Accordingly, neither the presence nor the absence of cross-hatching, contour lines, shading, or stippling conveys or indicates any preference or requirement for particular materials, material properties, element proportions, element dimensions, commonalities of similarly illustrated elements, or any other characteristic, attribute, or property for any element illustrated in the accompanying figures.

Additionally, it should be understood that the proportions and dimensions (either relative or absolute) of the various features and elements (and collections and groupings thereof) and the boundaries, separations, and positional relationships presented therebetween, are provided in the accompanying figures merely to facilitate an understanding of the various example embodiments described herein and, accordingly, may not necessarily be presented or illustrated to scale, and are not intended to indicate any preference or requirement for an illustrated embodiment to the exclusion of embodiments described with reference thereto.

Figure 1A:
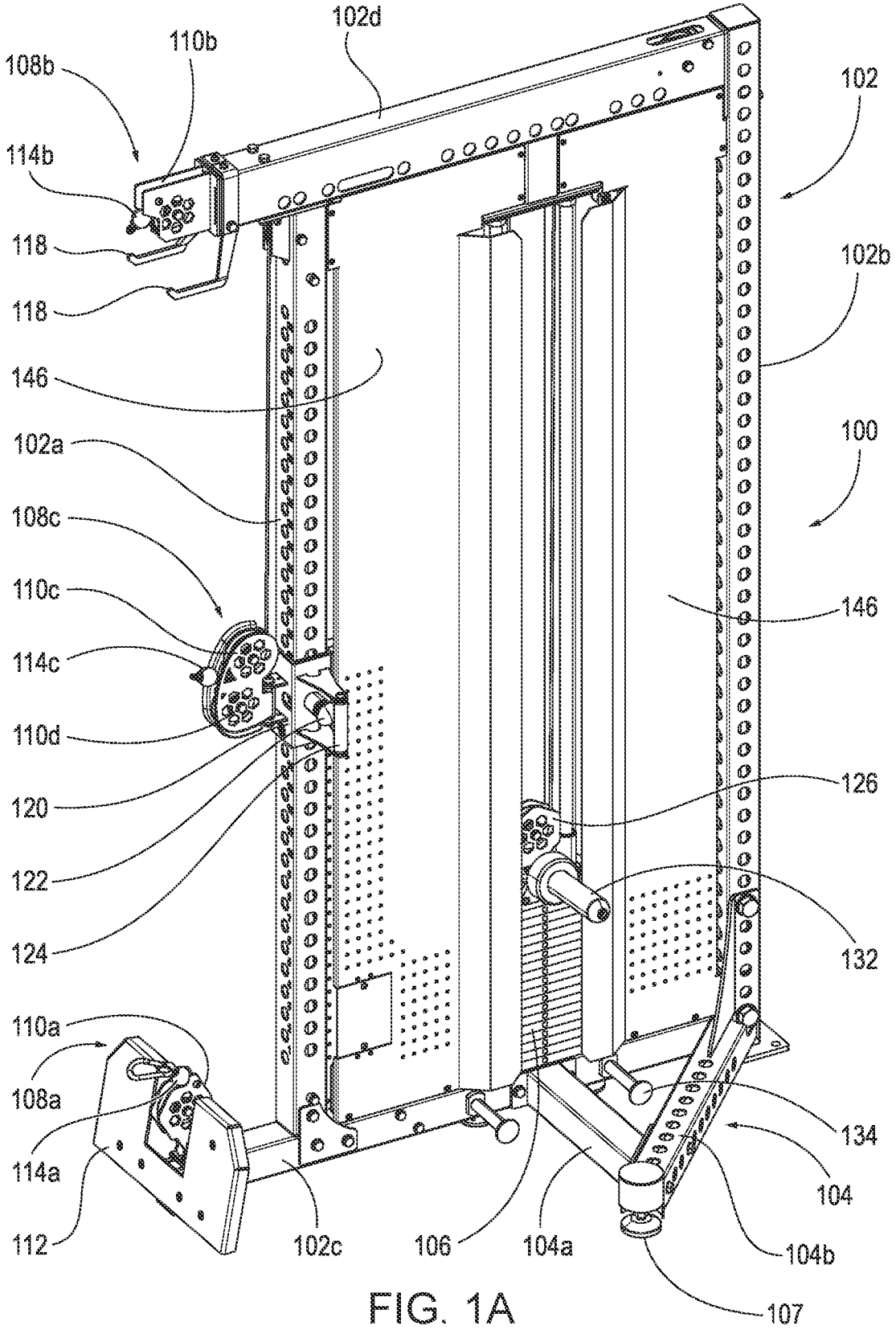

FIG. 1A is a top, front, right side isometric view of an exemplary embodiment of a weightlifting system.

Figure 1B:
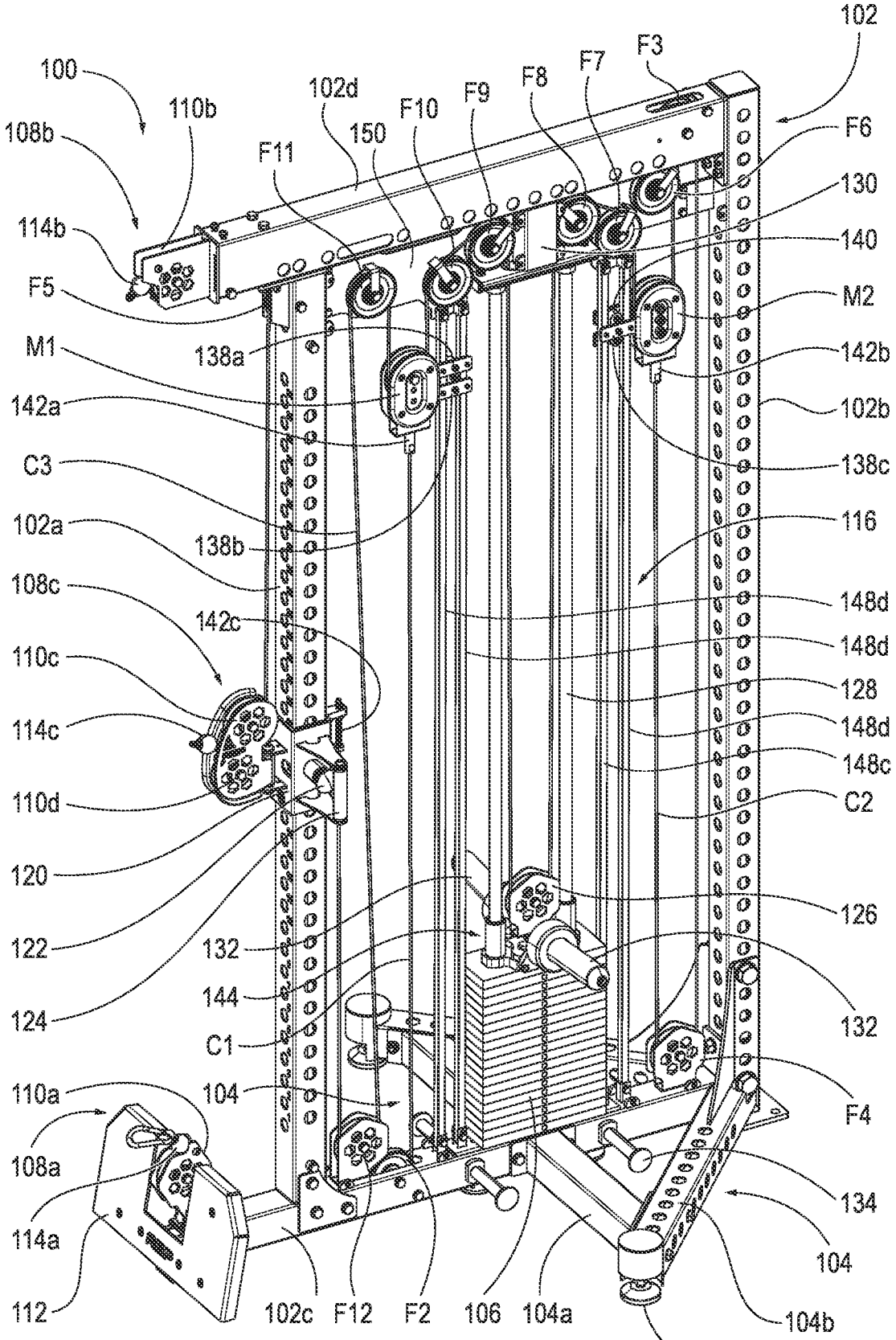

FIG. 1B is a top, front, right side isometric view of the weightlifting system of FIG. 1A with a cover removed to reveal a shrouded cable-pulley system.

Figure 2:
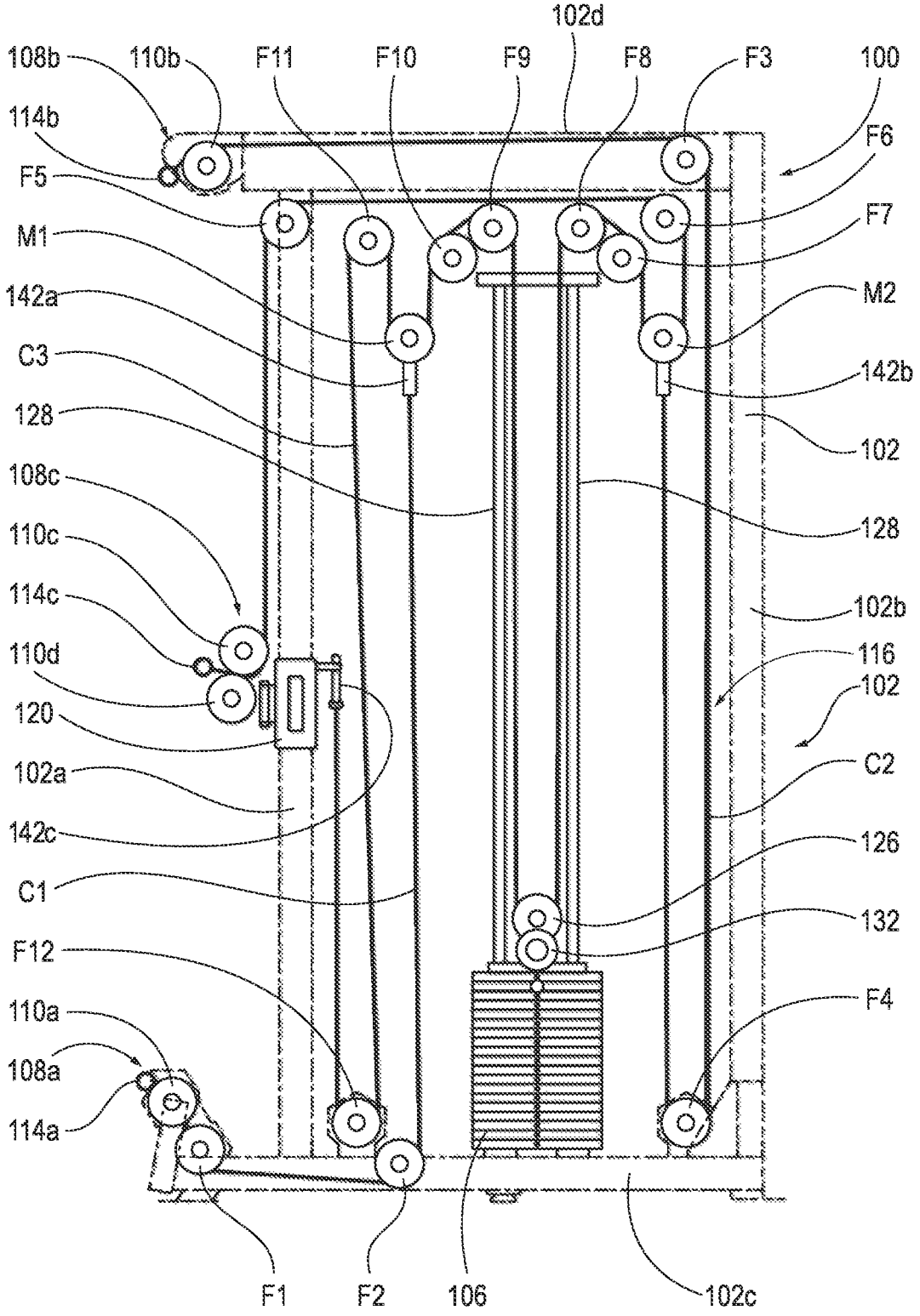

FIG. 2 is a schematic drawing from a side elevation view of the cable-pulley system of the weightlifting system of FIG. 1A depicting a cable routing configuration.

Figure 2A:
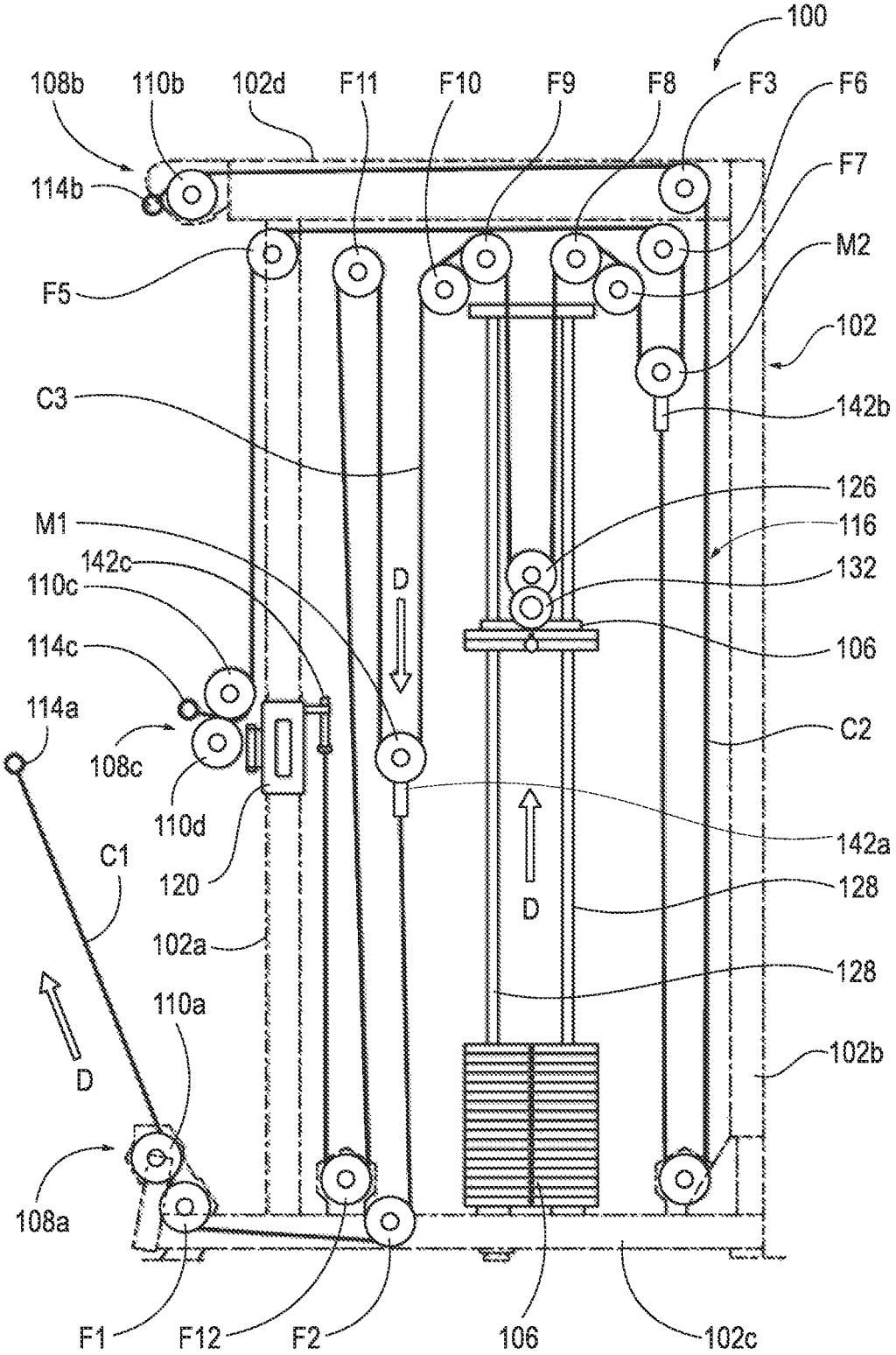

FIG. 2A depicts a lower-end cable in an actuated condition in the context of the schematic drawing of FIG. 2.

Figure 2B:
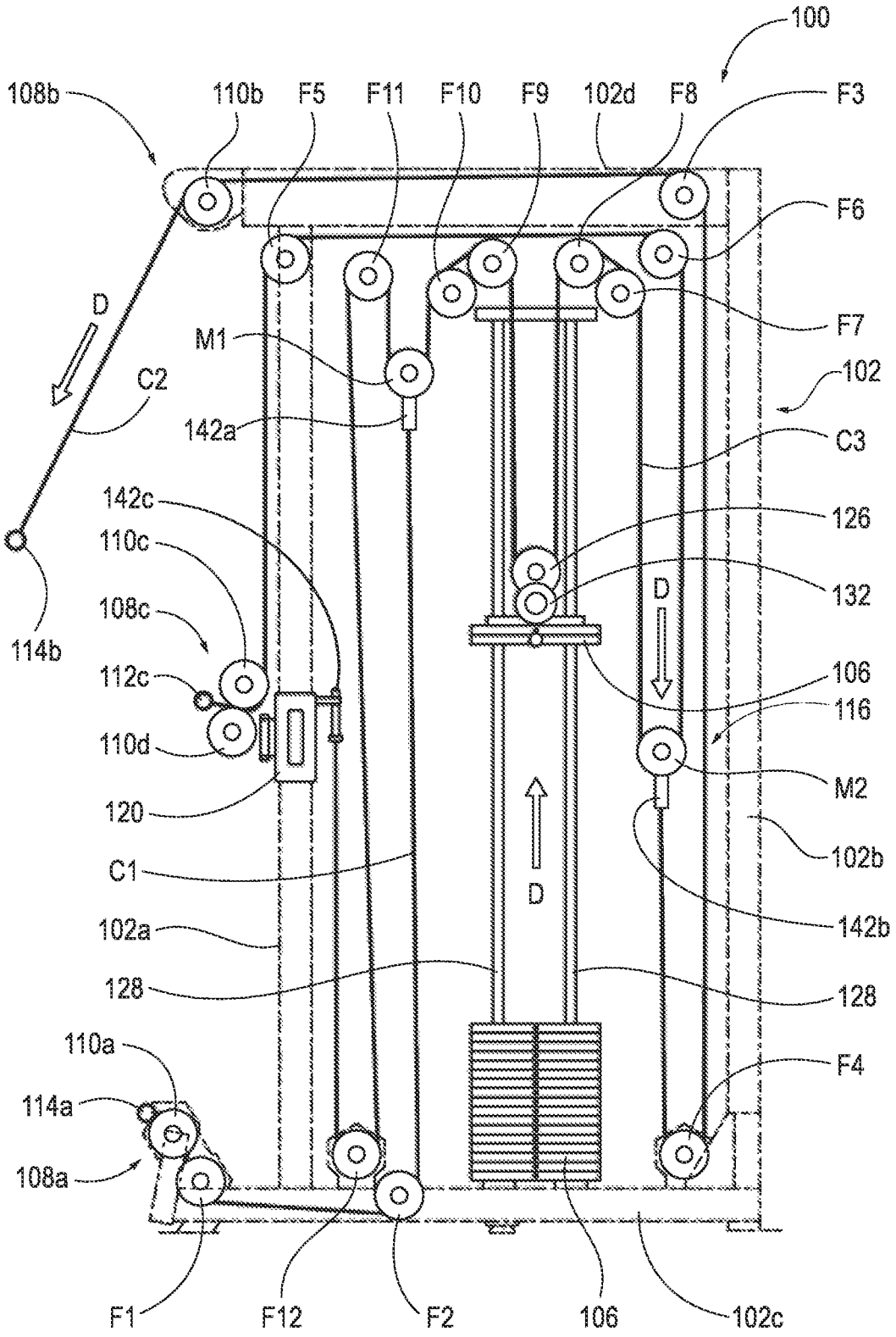

FIG. 2B depicts an upper-end cable in an actuated condition in the context of the schematic drawing of FIG. 2.

Figure 2C:
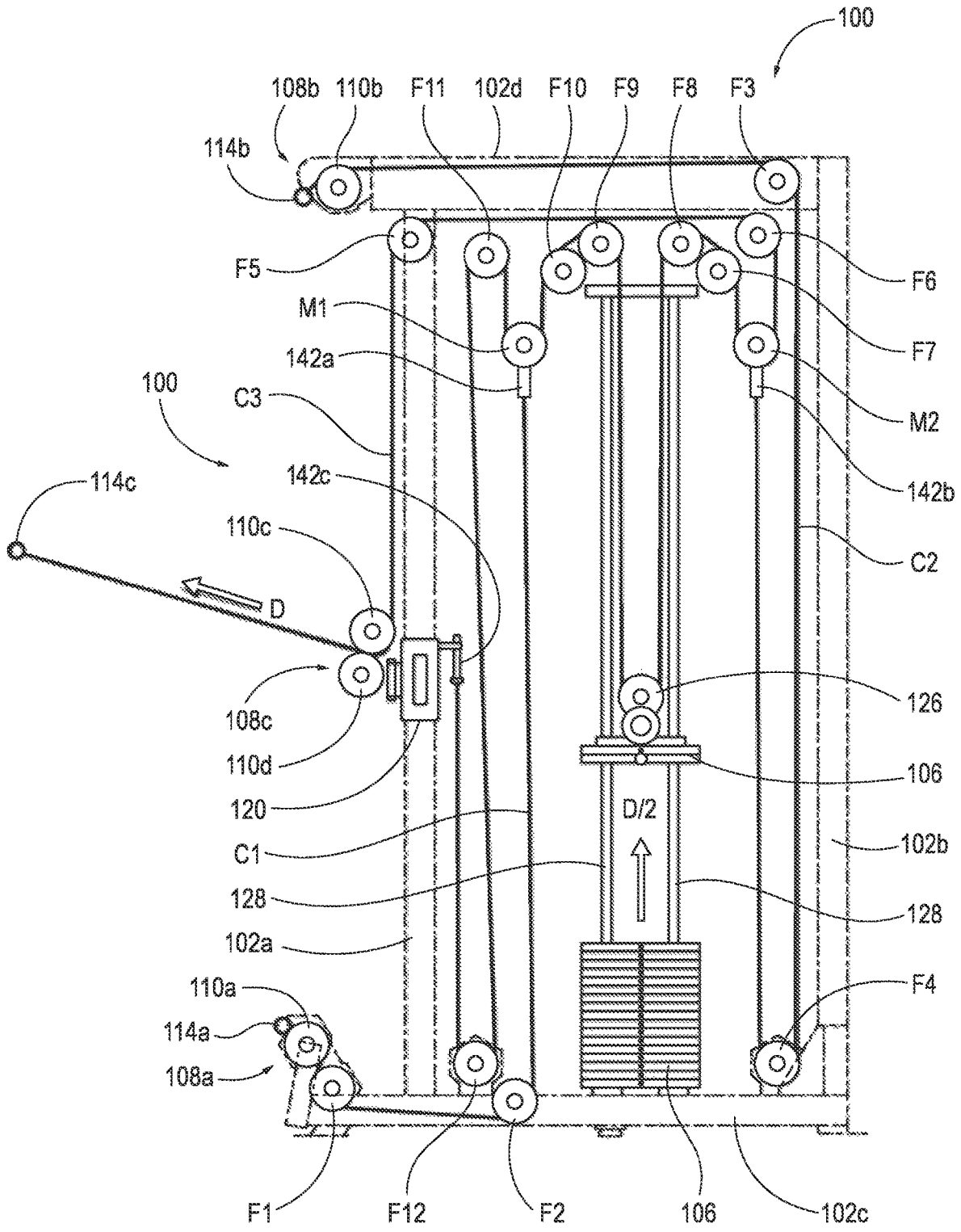

FIG. 2C depicts a middle cable in and actuated condition in the context of the schematic drawing of FIG. 2.

DETAILED DESCRIPTION

FIGS. 1A-1B depict isometric views of a weightlifting system 100, which may also be referred to herein as an exercise system, as well as components thereof. FIG. 2 depicts the weightlifting system 100 with the covers or shrouds 146 removed to reveal the cable-pulley system protected and hidden underneath. In FIGS. 1A and 1B, a frame 102 may be formed of steel or other robust metal tubing sized as required or desired for a particular application, e.g., 1½", 2", 3" square tubing and larger. Tubing formed of 12 G, 10 G, 8 G, and larger gauge materials are contemplated. The steel tubing of the frame 102 can be perforated at regular intervals with openings sized to receive bolts, pins, screws, or other elongate elements that project from the various components that make up the weightlifting system 100.

The frame 102 includes a pair of vertical members, i.e., a front post 102*a* and a rear post 102*b*, a lower crossmember 102*c*, and an upper crossmember 102*d*. Each of the ends of the lower crossmember 102*c* the upper crossmember 102*d* are secured to adjacent lower and upper ends of the front post 102*a* and the rear post 102*b*, respectively. The various components of the weightlifting system 100 can be attached to the frame 102 or other components of the weightlifting system 100 with one or more of mounting plates, brackets, or receivers, depending on attachment location, required robustness, etc. Certain of the mounting plates, brackets, or receivers may be selectively movable and/or positionable. In examples, it may be advantageous to utilize bolts or pins or other removable elements to secure the mounting plates, brackets, and receivers to the frame 102 or other components of the weightlifting system 100. Use of mechanical fasteners may enable an end user to assemble the weightlifting system on their own. Welded components may typically be more appropriate for components shipped fully assembled from a manufacturer. Regardless, the type of connection elements (mounting plate, bracket, receiver, etc.) and the type of connection to an adjacent element (bolt, weld, pin, etc.) should not be considered limiting. The weightlifting system 100 described herein is depicted for illustrative purposes only for certain contemplated configurations; other configurations would be apparent to a person of skill in the art.

To prevent the example implementation of the weightlifting system 100 from being inadvertently tipped, the weightlifting system 100 can include a pair of lateral support elements 104, one projecting from each side of the weightlifting system 100. (Note, only a single lateral support element 104 is visible in FIG. 1A, but both lateral support elements 104 (oppositely disposed) are visible in FIG. 1B.) In example implementations, the lateral support elements 104 can include a strut 104*a* and a leg 104*b*. The strut 104*a* extends from the lower crossmember 102*c*, e.g., from a location at or around a mid-point thereof. In the depicted example, the strut 104*a* may project from a location adjacent a weight stack 106 (described in more detail below), which positions the strut 104*a* near the center of mass of the weightlifting system 100. The leg 104*b* is connected to either or both of the lower crossmember 102*c* and the rear post 102*b* and extends at an angle from the side(s) thereof. The strut 104*a* may be secured to the leg 104*b* to form the robust lateral support element 104. In other examples, each lateral support element 104 may include a second leg that extends from a location at or near the front post 102*a* and may be secured to strut 104*a* and/or the leg 104*b*. In still other examples, the lateral support elements may include one or more legs that extend substantially orthogonally from the lower crossmember 102*c*. Regardless of configuration, the leg(s) may terminate at adjustable feet 107 that may be used to ensure a level support of the weightlifting system 100.

A user may utilize the weightlifting system 100 at a plurality of stations, each of which may be used for a variety of exercises. A lower pulley station 108*a* includes a lower fixed pulley 110*a* that is secured to or near a front end of the lower crossmember 102*c*. An optional foot plate 112 can be telescopically secured to the lower member 102*c* and may be used for certain types of exercises. To use the lower pulley station 108*a*, a user may connect a handle, bar, or other gripping implement (not shown) to a cable stop 114*a* at a first end of a lower cable C1 of a cable-pulley system 116 that is disposed within the frame 102. The user can pull on and allow retraction of the first end of the lower cable C1 as required or desired for a particular exercise, which moves the weight stack 106 as resistance. Operation of the cable-pulley system 116 is described in more detail below. The lower pulley station 108*a* may be used for a number of exercises including, but not limited to, seated rows (with the user's feet braced against the foot plate 112), upright rows, leg abductions and adductions, etc.

An upper pulley station 108*b* includes an upper fixed pulley 110*b* that is secured to or near a front end of the upper crossmember 102*d*. One or more optional hooks or arms 118 may be secured to the upper crossmember 102*d* and may be used to position or hold a pull-down bar or other handle implement when not in use. To use the upper pulley station 108*b*, a user may connect a handle, bar, or other gripping implement (not shown) to a cable stop 114*b* at a first end of an upper cable C2 of the cable-pulley system 116 to pull on and allow retraction of the first end of the upper cable C2 as required or desired for a particular exercise, which moves the weight stack 106 as resistance. The upper pulley station 108*b* may be used for a number of exercises including, but not limited to, lat pulldowns, stiff arm lat pulldowns, one-arm cable flys, etc.

A middle pulley station 108*c* includes a pair of pulleys, i.e., upper dual pulley 110*c* and lower dual pulley 110*d*, or referred to herein together as a dual middle pulley 110*c/d*, that is moveably secured to the front post 102*a*. The dual middle pulleys 110*c/d* are secured to a trolley or carriage 120 that is moveably positionable along a plurality of vertical positions the front post 102*a*. A pin 122 is retractably coupled to the carriage 120 for selectively securing the carriage 120 to the front post 102*a*. A handle 124 is secured to the carriage 120 to aid in allowing a user of the weightlifting system 100 in positioning the carriage 120 vertically along the front post 102*a*. In the depicted configuration, the handle 124 and pin 122 are positioned on a side surface of the carriage 120, but other locations are contemplated. The upper dual pulley 110*c* and the lower dual pulley 110*d* allow for use with any number of various exercises as the carriage 120 is used to reposition the middle pulley station 108*c* in any of the plurality of vertical positions along the front post 102*a*. To use the middle pulley station 108*c*, once the middle pulley station 108*c* is vertically positioned along the front post 102*a* as desired, a user may connect a handle, bar, or other gripping implement (not shown) to a cable stop 114*c* of a first end of a middle cable C3 of the cable-pulley system 116. The user can pull on and allow retraction of the first end of the middle cable C3 at the middle pulley station 108*c* as required or desired for a particular exercise, which moves the weight stack 106 as resistance.

The middle pulley station 108*c* may be used for a number of exercises, e.g., one-arm cable fies (at an angle different than that from the upper pulley station 108*b*), tricep presses, bicep curls, etc. When positioned at or near the lower pulley station 108*a*, the middle cable C3 can be pulled upward about the upper dual pulley 110*d* such that the middle pulley station 108*c* may also be used for exercises similar to those performed at the lower pulley station 108*a*. Similarly, when positioned at or near the upper pulley station 108*b*, the middle cable C3 can be pulled downward along the lower dual pulley 110*d* such that the middle pulley station 108*c* may also be used for exercises similar to those performed at the upper pulley station 108*b*.

Resistance to exercises performed with the weightlifting system 100 is provided by a load attachment structure. In the example implementation of the weightlifting system 100, several types of load attachment structures are provided: a weight stack 106, weight posts or horns 132, and resistance band pegs 134, which can be used separately or in combination with each other. It is further contemplated that in other example implementations, fewer than all three load attachment structures can be provided, i.e., only one or two of the options.

The weight stack 106 includes a plurality of weight plates stacked on top of each other. A selectively removable pin (not shown) is provided for selecting a desired number of weight plates to provide the load for a particular exercise. The pin projects into bores in a lifting rod (not shown) that extends through the wight plates to select the weight plates above and including the plate in which the pin is inserted. A load pully 126 can seat on and be fixed to a lifting structure 144 positioned on top of the weight stack 106 that connects to the lifting rod. A lifting force applied to the cable-pulley system 116 routed around the load pulley 126 lifts the selected portion of the weight stack 106 during exercise. When lifted and lowered, the weight stack 106 slides along a weight stack rail system formed by a pair of weight stack rails 128. The weight stack rails 128 span and are secured at lower ends to the lower crossmember 102*c* and at the upper ends to the upper crossmember 102*d* or, in this case, a support 130 extending therefrom.

If additional resistance, or an alternative form of resistance, for an exercise is needed or desired, one or more weight plates may be placed on plate horns 132 extending from opposing sides of the lifting structure 144 of the weight stack 106. Alternatively or additionally, resistance bands may be secured to band pegs 134 that, in this example, are mounted to the lower crossmember 102*c* and may be placed around the plate horns 132. In some alternative implementations, the weight stack 106 can be eliminated and the lifting structure 144 can merely include weight plate horns 132 or, alternatively, resistance band pegs for connection of a resistance band to the lifting structure 144 and the resistance band pegs 134 on the lower crossmember 102*c*.

As depicted in FIG. 1A, covers or shrouds 136 may substantially shield the weight stack 106, weight stack rails 128, and the cable-pulley system 116, depicted in FIG. 1B (in which the shrouds 136 are removed) to prevent inadvertent contact between a user and those components during movement. As depicted in FIG. 1B, the cable-pulley system 116 includes a plurality of cables, lower cable C1, upper cable C2, and middle cable C3 routed through a plurality of fixed pulleys (i.e., fixed pulleys F1-F12) and floating or moveable pulleys (i.e., moveable pulleys M1 and M2), and is described in more detail below. As used herein, the term "fixed pulley" means a pulley that is fixed in place relative to the frame 102 during use of the system 100; the term "moveable pulley" means a pulley that moves or translates relative to the frame 102 during exercise use of the system 100. For further illustrative context, the lower pulley 110*a*, upper pulley 110*b*, and dual middle pulley 110*c* are also "fixed" during use, although the dual middle pulley 110*c* is moveable along the front post 102*a* before locking in place for use. The load pulley 126 is also "moveable" or "translatable", as those terms are understood in the context of this application.

FIG. 2 depicts a schematic drawing of the cable-pulley system 116 and cable routing configuration for the weightlifting system 100 of FIGS. 1A and 1B. The frame 102 is depicted in broken lines. The cable-pulley system 116 includes a cable system formed from three cables: the lower cable C1, the upper cable C2, and the middle cable C3 in FIG. 2. The cable-pulley system 116 also includes a plurality of fixed pulleys F1-F12 and movable pulleys M1-M2. In example implementations, the load pulley 126 may also be considered a part of the cable-pulley system 116. Fixed pulleys F6-F11 can be mounted to a mounting plate 150 fixed to and extending beneath and along the upper crossmember 102*d*. Two pairs of guide rods 148*a-d* can be mounted at top ends to the mounting plate 150 and at bottom ends to the lower cross member 102*c*. The guide rods 148*a/b* and 148*c/d* in each pair extend in parallel and are spaced apart from each other. The first pair of guide rods 8*a/b* is positioned in front of the weight stack 106. The second pair of guide rods 148*c/d* is positioned behind the weight stack 106.

Each of the moveable pulleys M1 and M2 has a set of fingers 138*a-c* that extend from lateral side thereof. Two fingers 138*a/b* extend from a first face of each of the moveable pulleys M1 and M2 and a third finger 138*c* extends from a second face of each of the moveable pulleys M1 and M2 such that there is a separation distance between a first plane containing the first and second fingers 138*a/b* and a second parallel plane containing the third finger 138*c*. All of the fingers 138*a-c* are aligned horizontally in parallel, the first and second fingers 138*a/b* can be spaced vertically apart from each other, and the third finger 138*c* can be positioned vertically between the first and second fingers 138*a/b*. (It may be appreciated that the moveable pulleys M1 and M2 are identical in construction but oriented in opposing directions as depicted in FIG. 1B.) The fingers 138*a-c* extend across the width of respective pairs of the guide rods 148*a-d* and capture the pairs of guide rods 148*a-d* between the fingers 138*a-c* of each of the moveable pulleys M1 and M2, respectively.

Respective guide pucks 140 are mounted between the fingers 138*a-c* of each of the moveable pulleys M1 and M2 and are captured between the respective pairs of the guide rods 148*a-d*. In the example implementation, the guide pucks 140 are stadium-shaped, molded plastic biscuits with a low coefficient of friction. The guide pucks 140 as captured between the fingers 138*a-c* and the guide rods 148*a-d* assist in maintaining appropriate angular alignment of the moveable pulleys M1 and M2 and prevent rotation on a vertical axis which could cause interference and friction between the moveable pulleys M1 and M2 and the inner walls of the shrouds 146 as the moveable pulleys M1 and M2 travel up and down.

The lower cable C1 terminates at a first end with the cable stop 114*a*, which is restrained in a resting position by the fixed lower pulley 110*a* in the lower pulley station 108*a* from which the lower cable C1 is accessible by a user. The lower cable C1 passes around the fixed lower pulley 110*a* and travels downward to fixed pulley F1, which directs the lower cable C1 rearward along the lower crossmember 102*c* to fixed pulley F2. The fixed pulley F2 directs the lower cable C1 upward toward the first moveable pulley M1. After routing through the cable-pulley system 116, the lower cable C1 terminates at a second end at a cable anchor 142*a* connected to a base of the first movable pulley M1.

The upper cable C2 terminates at a first end with the cable stop 114*b*, which is restrained in a resting position by the fixed upper pulley 110*b* in the upper pulley station 108*b* from which the upper cable C2 is accessible by a user. The upper cable C2 passes around the fixed upper pulley 110*b* and travels rearward along the upper crossmember 102*d* to fixed pulley F3. The upper cable C3 is directed downward by fixed pulley F3 adjacent to and parallel to the rear post 102*b* to fixed pulley F4 mounted to the lower crossmember 102*c* at a position adjacent to the rear post 102*b*. The fixed pulley F4 directs the upper cable C2 upward toward the second moveable pulley M2. After routing through the cable-pulley system 116, the upper cable C2 terminates at a second end at a cable anchor 142*b* connected to a base of the second movable pulley M2.

The middle cable C3 terminates at a first end with the cable stop 114*c*, which is restrained in a resting position by the dual middle pulleys 110*c/d* in the middle pulley station 108*c*, from which the middle cable C3 is accessible by a user. The middle cable passes around the upper dual pulley 110*c* in the middle pulley station 108*c* and is directed upward parallel to the front post 102*a* to fixed pulley F5, which is mounted to the top of the front post 102*a* beneath the upper crossmember 102*d*. The middle cable C3 is redirected rearward by fixed pulley F5 parallel to the upper crossmember 102*d* toward fixed pulley F6, which is mounted beneath the upper crossmember 102*d* adjacent to the rear post 102*b*. The fixed pulley F6 directs the middle cable C3 downward to the second moveable pulley M2.

The middle cable wraps around the second moveable pulley M2 and is redirected upward to fixed pulleys F7 and F8, which adjust the middle cable C3 to a position above the lifting structure 144 and direct it downward to the load pulley 126. The middle cable C3 wraps around the load pulley 126 and is redirected upward to fixed pulleys F9 and F10 mounted beneath the upper crossmember 102*d*. The fixed pulleys F9 and F10 adjust the middle cable C3 to a position above the first moveable pulley M1 and direct it downward. The middle cable passes around the first moveable pulley M1, which redirects the middle cable upward to fixed pulley F11, which is mounted beneath the upper crossmember 102*d*. The middle cable C3 wraps around fixed pulley F11 and is directed downward to fixed pulley F12, which is mounted to the lower crossmember 102*c* adjacent to the front post 102*a*. Fixed pulley F12 redirects the middle cable 3 upward toward the carriage 120. After routing through the cable-pulley system 116, the second end of the middle cable C3 terminates at and is fixed to a cable anchor 142*c* on the carriage 120.

Upward movement of the carriage 120 along the front post 102*a* (e.g., positioning the carriage 120 closer to the upper pulley station 108*a*) causes corresponding upward movement of both the first and the second ends of the middle cable C3 restrained by and secured to the carriage 120, respectively. The middle cable C3 thus maintains a constant length within the cable-pulley system 116, regardless of the vertical position of the carriage 120, and avoids the formation of any slack.

FIGS. 2A-2C are schematic drawings of the cable-pulley system 116 and cable routing configuration of FIG. 2 in different active configurations. FIG. 2A depicts the cable-pulley system 116 with the lower cable C1 actuated by a user. FIG. 2B depicts the cable-pulley system 116 with the upper cable C2 actuated by a user. FIG. 2C depicts the cable-pulley system 116 with the middle cable C3 actuated by a user.

Beginning with FIG. 2A, the cable stop 114*a* of lower cable C1 is pulled a distance D away from the lower pulley station 108*a*. The lower cable C1 is routed through the fixed lower pulley 110*a*, fixed pulley F1, and fixed pulley F2 to extend upward and attach to the cable anchor 142*a* on the base of the moveable pulley M1. The pulling force of the user and resulting extension of the lower cable C1 outward from the lower pulley station 108*a* pulls moveable pulley M1 downward a distance D (i.e., the same distance D as the movement of the cable stop 114*a* of the lower cable C1 extends from the lower pulley station 108*a*). As noted, the middle cable C3 travels around the moveable pulley M1 and the load pulley 126. As the moveable pulley M1 is pulled downward by the lower cable C1, a section of the middle cable C3 is pulled downward the same distance D and the load pulley 126 is lifted upward the same distance D because both ends of the middle cable C3 remain in fixed positions. Since the load pulley 126 is attached to the lifting structure 144, any selected weight plates from the weight stack 106 (or other resistance or load attached) are also lifted upward the distance D. Thus, since the distance D pulled out at the user end of the lower cable C1 moves the weight stack 106 the same distance D, the portion of the cable-pulley system 116 associated with the lower pulley station 108*a* provides a resistance force with respect to the load (e.g., the weight stack 106) at a 1:1 ratio.

Turning to FIG. 2B, the cable stop 114*b* of upper cable C2 is pulled a distance D away from the upper pulley station 108*b*. The upper cable C2 is routed through the fixed upper pulley 110*b*, fixed pulley F3, and fixed pulley F4 to extend upward and attach to the cable anchor 142*b* on the base of the moveable pulley M2. The pulling force of the user and resulting extension of the upper cable C2 outward from the upper pulley station 108*b* pulls moveable pulley M2 downward a distance D (i.e., the same distance D as the movement of the cable stop 114*b* of the upper cable C2 extends from the upper pulley station 108*b*). As noted, the middle cable C3 travels around the moveable pulley M2 and the load pulley 126. As the moveable pulley M2 is pulled downward by the upper cable C2, a section of the middle cable C3 is pulled downward the same distance D and the load pulley 126 is lifted upward the same distance D because both ends of the middle cable C3 remain in fixed positions. Since the load pulley 126 is attached to the lifting structure 144, any selected weight plates from the weight stack 106 (or other resistance or load attached) are also lifted upward the distance D. Thus, since the distance D pulled out at the user end of the upper cable C2 moves the weight stack 106 the same distance D, the portion of the cable-pulley system 116 associated with the upper pulley station 108*b* provides a resistance force with respect to the load (e.g., the weight stack 106) at a 1:1 ratio.

Turning to FIG. 2C, the cable stop 114*c* of the middle cable C3 is pulled a distance D away from the middle pulley station 108*c*. As described above, the middle cable C3 travels around the first moveable pulley M1 and the second moveable pulley M2. In this situation, however, the user ends of each of the lower cable C1 and the upper cable C2 are static of fixed in their positions as the cable stop 114*a* engages the lower pulley station 108*a* and the cable stop 114*b* engages the upper pulley station 108*b*, respectively. Therefore, the first moveable pulley M1 and the second moveable pulley M2, attached to the opposite ends of the lower cable C1 and the upper cable C2 at cable anchors 142*a* and 142*b*, respectively, also remain in static positions while the middle cable C3 is pulled by a user. An intermediate section of the middle cable C3 thus pulls the load pulley 126 and attached load upward, but the distance traveled upward by the load pulley 126 in this situation is half the distance D (i.e., D/2) of the payout of the user end of middle cable C3 from the middle pulley station 108*c* The combination of fixed pulleys F8 and F9 and the load pulley 126 thus provide a 2:1 mechanical advantage as middle cable 3 is pulled by a user, halving the actual load of the weight stack 106 or other resistance force attached to the lifting structure 144.

As can be perceived from FIGS. 2-2C, the moveable middle pulley station 108*c* can be used to greatly increase the versatility and useability of the weightlifting system 100. As described above, the lower pulley station 108*a* and upper pulley station 108*b* are configured for a 1:1 ratio with respect to the load (i.e., no mechanical advantage is provided; the pulleys merely redirect the cables). In contrast, the middle pulley station 108*c* is configured at a 2:1 ratio with respect to the load, i.e., a 2 to 1 mechanical advantage is provided. Thus, a user performing an exercise using the middle pulley station 108*c* will encounter a resistance force of half the load (e.g., half the weight of the weight plates or other resistance force attached to the lifting structure 144).

This configuration of the weightlifting system 100 allows a user to more easily exercise a particular muscle or muscle group to so-called "exhaustion." In such an example, the user may position the middle pulley station 108*c* in a position near to the lower pulley station 108*a* and connect a bar (not shown) to each of the lower cable stop 114*a* of lower cable 1 and the upper cable stop 114*c* of the upper cable 3 of the cable-pulley system 116 in succession. The user may first perform an exercise (in this example, bicep curls) using the lower pulley station 108*a* and lower cable 1 connected to the full selected load of the weight stack 106 to exhaustion (e.g., until no more repetitions may be performed due to muscular failure). At that time, the user may release the handle from the lower cable C1 at the lower pulley station 108*a* and connect the handle to the middle cable stop 114*c* of the middle cable C3 at the middle pulley station 108*c* positioned adjacent to the lower pulley station 108*a*. The user can then perform additional bicep curls using the middle pulley station 108*c* to the point of exhaustion. Since the middle pulley station 108*c* is configured at a 2:1 ratio, the user can easily reduce (by half) the weight resistance inherent the exercise without having to adjust the weight stack 106 directly, enabling a faster transition between sets of exercises.

The configuration of the weightlifting system 100 also allows a user to more easily exercise a particular muscle or muscle group in so-called "super sets". In such an example, a user may locate the middle pulley station 108*c* in a position adjacent to the upper pulley station 108*b* and connect a pull-down bar (not shown) to each of the cable stop 114*c* on the middle cable C3 and the cable stop 114*b* of the upper cable C2 of the cable-pulley system 116 in succession. The user can perform an exercise (in this example, stiff arm lat pulldowns) using the middle pulley station 108*c* to the desired number of repetitions. At that time, the user may release the handle from the middle cable C3 at the middle pulley station 108*c* and reconnect the handle to the upper cable C2 to perform lat pulldowns using the upper pulley station 108*b*. Typically, most users are able to perform lat pulldowns with a heavier weight than stiff arm lat pulldowns. Since the middle pulley station 108*c* is configured at a 2:1 ratio, the user can easily perform the first, lighter-weight set of stiff arm lat pulldowns before moving quickly to the second, heavier set of lat pulldowns with the full load selected (e.g., at the weight stack 106), without having to adjust the weight stack 106 directly, enabling a faster transition between exercise types. Other variations of exercises performed with the weightlifting system 100 described herein would be readily understood by users of the weightlifting system 100.

In view of the above specification and the related drawing figures, it can be understood that example implementations of a weightlifting system include a frame including a front post, a front post spaced apart from and parallel to the front post, a lower crossmember connected between the front and rear posts at a base position, and an upper crossmember connected between the front and rear posts at an upper position. A load attachment structure is provided within the system. A lower pulley station is mounted on the frame and disposed proximate to the lower crossmember. An upper pulley station is mounted to the frame and disposed proximate to the upper crossmember. A middle pulley station is attached to the frame. A cable-pulley system includes a plurality of fixed pulleys mounted to the frame, a first moveable pulley, a second moveable pulley, and a floating load pulley mounted to the load attachment structure. A plurality of cables is collectively routed through the first movable pulley, the second movable pulley, the plurality of fixed pulleys, the floating load pulley, the lower pulley station, the upper pulley station, and the middle pulley station. When a first pulling force is applied to a first cable end of the plurality of cables routed through and accessible from the lower pulley station, the first movable pulley and the load pulley translate. When a second pulling force is applied to a second cable end of the plurality of cables routed through and accessible from the upper pulley station, the second movable pulley and the load pulley translate. When a third pulling force is applied to a third cable end of the plurality of cables routed through and accessible from the middle pulley station, only the floating load pulley translates.

In other example implementations of the weightlifting system, the plurality of cables can include a lower cable including the first cable end at a first end thereof and a first anchor end connected to the first moveable pulley. The plurality of cables can further include an upper cable including the second cable end at a first end thereof and a second anchor end connected to the second moveable pulley. The plurality of cables can further include a middle cable including the third cable end at a first end thereof, a third anchor end connected to the middle pulley station, and an intermediate section routed around the floating load pulley.

Other example implementations of the weightlifting system can further include a moveable carriage coupled to the front post and configured to translate up and down the front post and releasably affix to the front post at a plurality of positions along the front post. In such implementations, the middle pulley station can be connected to the carriage.

In other example implementations of the weightlifting system the middle pulley station can include two pulleys mounted within a same vertical plane on parallel horizontal axes.

In other example implementations of the weightlifting system, the first pulling force can translate the first movable pulley in a first direction and translate the floating load pulley in a second direction opposite the first direction.

In other example implementations of the weightlifting system, the second pulling force can translate the second movable pulley in a first direction and translate the floating load pulley in a second direction opposite the first direction.

In other example implementations of the weightlifting system, the first pulling force can be applied to the first cable end such that the lower cable extends a distance D beyond the first pulley station. The first movable pulley also translates the same distance D and the floating load pulley translates the same distance D.

In other example implementations of the weightlifting system the second pulling force can be applied to the second cable end such that the upper cable extends a distance D beyond the second pulley station. The second movable pulley also translates the same distance D and the floating load pulley translates the same distance D.

In other example implementations of the weightlifting system, the third pulling force can be applied to the third cable end such that the middle cable extends a distance D beyond the middle pulley station. The floating load pulley translates half the distance D (D/2).

In other example implementations of the weightlifting system, when a load of force W is attached to the load attachment structure, the first pulling force is equivalent to the force W, the second pulling force is equivalent to the force W, and the third pulling force is equivalent to one half the force W (W/2).

In other example implementations of the weightlifting system, the load attachment structure can include a weight stack composed of a plurality of selectable weight plates configured for variable load selection by a user.

In other example implementations of the weightlifting system, the load attachment structure can include one or more posts configured to receive and support barbell weight plates.

In other example implementations of the weightlifting system, the lower crossmember can include one or more pegs extending from a sidewall thereof configured to receive and retain a lower portion of an elastic resistance band. Similarly, the load attachment structure can include one or more posts configured to receive and retain an upper portion of the elastic resistance band.

In other example implementations of the weightlifting system, the frame can further include a mounting plate fixed to and extending beneath the upper crossmember between the front post and the rear post. A first subset of the fixed pulleys can be mounted to the upper crossmember. A second subset of the fixed pulleys subset can be mounted to the mounting plate.

Other example implementations of the weightlifting system can further include a first guide rod positioned in front of the load attachment structure and extending vertically between and connected to the mounting plate at a first end and the lower crossmember at a second end; and also a second guide rod positioned behind the load attachment structure and extending vertically between and connected to the mounting plate at a first end and the lower crossmember at a second end. The first and second moveable pulleys can each include an attachment structure extending from a side thereof and configured to slidably engage with the first and second guide rods, respectively, as the first and second moveable pulleys move upward and downward.

In other example implementations of the weightlifting system, the attachment structure can further include a plurality of fingers that extend parallel to each other, one or more from a first face of each of the first and second moveable pulleys and one or more from second face of each of the first and second moveable pulleys. The attachments system can also include a puck that is fastened between the plurality of fingers, positioned between a first plane of the first face and a second plane of the second face, and seated on a side of the first or second guide rod opposite the first or second moveable pulley. Additionally, the first or second guide rod can be positioned between the plurality of fingers, the puck, and the first or second movable pulley, respectively.

Other example implementations of the weightlifting system can further include a third guide rod positioned in front of the first guide rod and extending vertically between and connected to the mounting plate at a first end and the lower crossmember at a second end and also a fourth guide rod positioned behind the second guide rod and extending vertically between and connected to the mounting plate at a first end and the lower crossmember at a second end. The puck associated with the first moveable pulley can be positioned between the first and third guide rods and the plurality of fingers associated with the first moveable pulley extend transversely across the third guide rod. Similarly, the puck associated with the second moveable pulley can be positioned between the second and fourth guide rods and the plurality of fingers associated with the second moveable pulley extend transversely across the fourth guide rod.

Other example implementations of the weightlifting system can further include a pair of struts extending from respective lateral sidewalls of the lower crossmember.

Other example implementations of the weightlifting system can further include a pair of legs connected at first ends to respective lateral sides of the rear post and extending at an angle with respect to the lower crossmember within a plane including the struts and connecting with respective ones of the struts at second ends.

Other example implementations of the weightlifting system can further include a foot plate connected to the frame adjacent to the lower pulley station.

All directional references (e.g., proximal, distal, upper, lower, upward, downward, left, right, lateral, longitudinal, front, back, top, bottom, above, below, vertical, horizontal, radial, axial, clockwise, and counterclockwise) are only used for identification purposes to aid the reader's understanding of the structures disclosed herein, and do not create limitations, particularly as to the position, orientation, or use of such structures. Connection references (e.g., attached, coupled, connected, and joined) are to be construed broadly and may include intermediate members between a collection of elements and relative movement between elements unless otherwise indicated. As such, connection references do not necessarily infer that two elements are directly connected and in fixed relation to each other. The exemplary drawings are for purposes of illustration only and the dimensions, positions, order, and relative sizes reflected in the drawings attached hereto may vary.

In addition, any disclosure of components contained within other components or separate from other components should be considered exemplary because multiple other architectures may potentially be implemented to achieve the same functionality, including incorporating all, most, and/or some elements as part of one or more unitary structures and/or separate structures.

The detailed description set forth above in connection with the appended drawings describes examples and does not represent the only instances that may be implemented or that are within the scope of the claims. The terms "example" and "exemplary," when used in this description, mean "serving as an example, instance, or illustration," and not "preferred" or "advantageous over other examples."

As used herein, including in the claims, the term "and/or," when used in a list of two or more items, means that any one of the listed items can be employed by itself, or any combination of two or more of the listed items can be employed. For example, if a composition is described as containing components A, B, and/or C, the composition can contain A alone; B alone; C alone; A and B in combination; A and C in combination; B and C in combination; or A, B, and C in combination. Also, as used herein, including in the claims, "or" as used in a list of items (for example, a list of items prefaced by a phrase such as "at least one of" or "one or more of") indicates a disjunctive list such that, for example, a list of "at least one of A, B, or C" means A or B or C or AB or AC or BC or ABC, or A and B and C.

The above specification, examples and data provide a complete description of the structure and use of exemplary embodiments of the invention as defined in the claims. Although various embodiments of the claimed invention have been described above with a certain degree of particularity, or with reference to one or more individual embodiments, other embodiments using different combinations of elements and structures disclosed herein are contemplated, as other iterations can be determined through ordinary skill based upon the teachings of the present disclosure. It is intended that all matter contained in the above description and shown in the accompanying drawings shall be interpreted as illustrative only of particular embodiments and not limiting. Changes in detail or structure may be made without departing from the basic elements of the invention as defined in the following claims.

The invention claimed is:

1. A weightlifting system comprising a frame comprising a front post, a rear post spaced apart from and parallel to the front post, a lower crossmember connected between the front and rear posts at a base position, and an upper crossmember connected between the front and rear posts at an upper position;

a load attachment structure;

a lower pulley station mounted on the frame and disposed proximate to the lower crossmember;

an upper pulley station mounted to the frame and disposed proximate to the upper crossmember;

a middle pulley station attached to the frame; and a cable-pulley system comprising a plurality of fixed pulleys mounted to the frame;

a first moveable pulley;

a second moveable pulley;

a floating load pulley mounted to the load attachment structure; and a plurality of cables collectively routed through the first movable pulley, the second movable pulley, the plurality of fixed pulleys, the floating load pulley, the lower pulley station, the upper pulley station, and the middle pulley station, wherein when a first pulling force is applied to a first cable end of the plurality of cables routed through and accessible from the lower pulley station, the first movable pulley and the floating load pulley translate;

a second pulling force is applied to a second cable end of the plurality of cables routed through and accessible from the upper pulley station, the second movable pulley and the floating load pulley translate; and a third pulling force is applied to a third cable end of the plurality of cables routed through and accessible from the middle pulley station, only the floating load pulley translates.

2. The weightlifting system of claim 1, wherein the plurality of cables comprises a lower cable including the first cable end at a first end thereof and a first anchor end connected to the first moveable pulley;

an upper cable including the second cable end at a first end thereof and a second anchor end connected to the second moveable pulley; and a middle cable including the third cable end at a first end thereof, a third anchor end connected to the middle pulley station, and an intermediate section routed around the floating load pulley.

3. The weightlifting system of claim 1 further comprising a moveable carriage coupled to the front post and configured to translate up and down the front post and releasably affix to the front post at a plurality of positions along the front post; and wherein, the middle pulley station is connected to the carriage.

4. The weightlifting system of claim 1, where in the middle pulley station includes two pulleys mounted within a same vertical plane on parallel horizontal axes.

5. The weightlifting system of claim 1, wherein the first pulling force translates the first movable pulley in a first direction and translates the floating load pulley in a second direction opposite the first direction.

6. The weightlifting system of claim 1, wherein the second pulling force translates the second movable pulley in a first direction and translates the floating load pulley in a second direction opposite the first direction.

7. The weightlifting system of claim 2, wherein when the first pulling force is applied to the first cable end and the lower cable extends a distance D beyond the first pulley station, the first movable pulley translates the same distance D and the floating load pulley translates the same distance D.

8. The weightlifting system of claim 2, wherein when the second pulling force is applied to the second cable end and the upper cable extends a distance D beyond the second pulley station, the second movable pulley translates the same distance D and the floating load pulley translates the same distance D.

9. The weightlifting system of claim 2, wherein the third pulling force applied to the third cable end and the middle cable extends a distance D beyond the middle pulley station, the floating load pulley translates half the distance D (D/2).

10. The weightlifting system of claim 1, wherein when a load of force W is attached to the load attachment structure the first pulling force is equivalent to the force W;

the second pulling force is equivalent to the force W; and the third pulling force is equivalent to one half the force W (W/2).

11. The weightlifting system of claim 1, wherein the load attachment structure comprises a weight stack composed of a plurality of selectable weight plates configured for variable load selection by a user.

12. The weightlifting system of claim 1, wherein the load attachment structure comprises one or more posts configured to receive and support barbell weight plates.

13. The weightlifting system of claim 1, wherein the lower crossmember comprises one or more pegs extending from a sidewall thereof configured to receive and retain a lower portion of an elastic resistance band; and the load attachment structure comprises one or more posts configured to receive and retain an upper portion of the elastic resistance band.

14. The weightlifting system of claim 1, wherein the frame further comprises a mounting plate fixed to and extending beneath the upper crossmember between the front post and the rear post;

a first subset of the fixed pulleys is mounted to the upper crossmember; and a second subset of the fixed pulleys subset is mounted to the mounting plate.

15. The weightlifting system of claim 14 further comprising a first guide rod positioned in front of the load attachment structure and extending vertically between and connected to the mounting plate at a first end and the lower crossmember at a second end; and a second guide rod positioned behind the load attachment structure and extending vertically between and connected to the mounting plate at a first end and the lower crossmember at a second end; and wherein the first and second moveable pulleys each comprise an attachment structure extending from a side thereof and configured to slidably engage with the first and second guide rods, respectively, as the first and second moveable pulleys move upward and downward.

16. The weightlifting system of claim 15, wherein the attachment structure further comprises a plurality of fingers that extend parallel to each other, one or more from a first face of each of the first and second moveable pulleys and one or more from second face of each of the first and second moveable pulleys;

a puck that is fastened between the plurality of fingers, positioned between a first plane of the first face and a second plane of the second face, and seated on a side of the first or second guide rod opposite the first or second moveable pulley, respectively, such that the first or second guide rod is positioned between the plurality of fingers, the puck, and the first or second movable pulley, respectively.

17. The weightlifting system of claim 16 further comprising a third guide rod positioned in front of the first guide rod and extending vertically between and connected to the mounting plate at a first end and the lower crossmember at a second end; and a fourth guide rod positioned behind the second guide rod and extending vertically between and connected to the mounting plate at a first end and the lower crossmember at a second end; and wherein the puck associated with the first moveable pulley is positioned between the first and third guide rods and the plurality of fingers associated with the first moveable pulley extend transversely across the third guide rod; and the puck associated with the second moveable pulley is positioned between the second and fourth guide rods and the plurality of fingers associated with the second moveable pulley extend transversely across the fourth guide rod.

18. The weightlifting system of claim 1, further comprising a pair of struts extending from respective lateral sidewalls of the lower crossmember.

19. The weightlifting system of claim 18, further comprising a pair of legs connected at first ends to respective lateral sides of the rear post and extending at an angle with respect to the lower crossmember within a plane including the struts and connecting with respective ones of the struts at second ends.

20. The weightlifting system of claim 1, further comprising a foot plate connected to the frame adjacent to the lower pulley station.

* * * * *